United States Patent [19]

Miller et al.

[11] 4,123,369

[45] Oct. 31, 1978

[54] LUBRICATING OIL COMPOSITION

[75] Inventors: Edsel L. Miller; Robert A. Krenowicz, both of Ponca City, Okla.

[73] Assignee: Continental Oil Company, Ponca City, Okla.

[21] Appl. No.: 746,284

[22] Filed: Dec. 1, 1976

[51] Int. Cl.[2] ..... C10M 1/48; C10M 3/42; C10M 5/24; C10M 7/46

[52] U.S. Cl. ..... 252/32.7 E; 252/33; 252/389 A

[58] Field of Search ..... 252/32, 7 E, 18, 33, 252/389 A

[56] References Cited

U.S. PATENT DOCUMENTS

| | | | |
|---|---|---|---|
| 3,562,159 | 2/1971 | Mastin | 252/32.7 E |
| 3,652,410 | 3/1972 | Hollingshurst et al. | 252/32.7 E |
| 4,010,106 | 3/1977 | Rothert | 252/32.7 E |
| 4,010,107 | 3/1977 | Rothert | 252/32.7 E |

*Primary Examiner*—Irving Vaughn
*Attorney, Agent, or Firm*—Richard W. Collins

[57] ABSTRACT

An extended service crankcase lubricating oil composition comprising a base oil and an additive package including a combination of alkaline earth metal sulfonate and alkaline earth metal phosphonate-phenate sulfide. This combination provides enhanced rust inhibition.

4 Claims, No Drawings

LUBRICATING OIL COMPOSITION

BACKGROUND OF THE INVENTION

1. Field of the Invention

This invention relates to lubricating oil compositions, and more particularly to extended service automobile crankcase lubricating oil compositions.

There is a current trend in the automobile industry toward longer intervals between recommended servicing of an automobile. This trend has created a need for crankcase lubricating oils that maintain their effectiveness for periods of four months and longer and for mileage intervals of 6,000 or more. This invention provides a lubricating oil composition which meets these requirements.

2. Prior Art

The automobile crankcase lubricating oil art has been thoroughly developed over the years such that those skilled in the art are able to formulate a lubricating oil composition having a wide variety of properties. The state of this art is well described in a book entitled *Motor Oils and Engine Lubrication* by Alphonse Schilling, distributed in the U.S. by Scholium International Inc. of Flushing, New York. This book describes in detail the various base stocks and additives which are available, and provides a great deal of information as to the particular properties which can be imported to a composition by addition of one or a combination of the many additives presently available. The Schilling book and U.S. Pat. No. 3,337,456 both describe basic alkaline earth metal sulfonates of the type commonly used as detergents and anti-wear additives. As is well known in the art, the highly basic sulfonates such as overbased magnesium-petroleum sulfonates are commonly used for this purpose.

Another additive commonly used in formulating lubricating oils is an alkaline earth metal phenate sulfide of the type described in the Schilling book and U.S. Pat. No. 2,916,454.

As is known in the art, many additives are multifunctional, and provide beneficial properties of more than one type. Also, most additives have an upper limit beyond which they lead to functional problems as well as being excessively costly. Thus, compositions providing extended service life are not readily attained simply by using higher levels of additives, and any composition which provides extended service life without excessive additive levels is much to be desired.

SUMMARY OF THE INVENTION

According to the present invention, an improved extended service automobile crankcase lubricating oil composition is provided which, due to a unique combination of additives, has unexpected anti-rust properties.

The composition of the invention is a high additive crankcase lubricating oil composition. It has been found that incorporation of a combination of highly overbased alkaline earth metal sulfonate and alkaline earth metal phosphonate-phenate sulfide provides greatly improved anti-rust properties over an identical composition utilizing only overbased alkaline earth metal sulfonate as the rust inhibitor. This result is particularly surprising since alkaline earth metal phenate sulfides do not contribute materially to anti-rust properties, and alkaline earth metal phosphonate-phenate sulfides are generally used for detergency and oxidation inhibition rather than for anti-rust properties.

It is accordingly an object of the present invention to provide an improved extended service lubricating oil composition.

It is a further object to provide such a composition which has improved and unexpected anti-rust properties.

DESCRIPTION OF THE PREFERRED EMBODIMENT

In accordance with the preferred embodiment of the invention, an extended service lubricating oil composition comprising a base oil and an additive package including a specific combination of additives provides superior rust inhibition properties.

The base stock utilized in this composition is not critical, and can be any suitable lubricating oil base stock as described in the aforementioned Shilling book. A particularly suitable base stock is a solvent refined neutral base oil having a viscosity selected to provide the desired viscosity rating of the finished composition. For example, a solvent refined neutral base oil having a viscosity of 100 SSU at 100° F. may be used, or a small amount of a solvent refined neutral base oil having a viscosity of 170 SSU at 100° F. may be blended therewith to obtain the desired viscosity grade oil.

The additive package utilized in the composition of this invention may vary considerably, but it is essential to the invention that a combination of an alkaline earth metal sulfonate and an alkaline earth metal phosponate-phenate sulfide be included in the additive package to provide the improved anti-rust properties to which this invention is specifically directed. A preferred additive package, in addition to the combination of additives required for the anti-rust properties, includes a conventional viscosity index improver, a zinc dithiophosphate compound for anti-wear and anti-oxidant, and an ashless dispersant for engine cleanliness. Each of these additives is well known in the art and is thoroughly discussed in the Schilling book referred to heretofore. The terms viscosity index improver, ashless dispersant and zinc dithiophosphate are used broadly herein, and are intended to include the many compounds generally referred to in the art by such broad terms. The specific compounds used for the purposes of viscosity index improvement, cleanliness, anti-wear and anti-oxidant do not constitute a part of the invention.

As used herein, the term alkaline earth metal sulfonate refers to highly overbased petroleum sulfonate salts such as are described in U.S. Pat. Nos. 3,133,019 and 3,158,572. One especially suitable sulfonate compound is a magnesium sulfonate having a base number of about 400 sold by Amoco Chemical Corporation as Amoco 9217.

The alkaline earth metal phosphonate-phenate sulfide compounds suitable for this invention are produced from alkyl phenol sulfides of the class represented by the general formula:

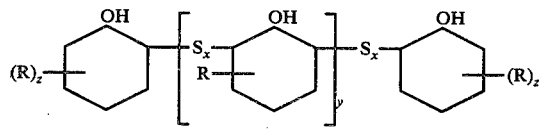

wherein R represents an alkyl radical having from about 5 to about 24 carbon atoms, $x$ represents an integer from 1 to 4, $y$ represents an integer from 0 to 3 and z represents an integer from 1 to 5. As is well known, the various alkyl phenol sulfides coming within the aforesaid formula may be prepared by reaction of the various alkylated phenols with either sulfur monochloride or sulfur dichloride in various proportions. In these reactions the proportions of alkyl phenol and sulfur chloride used affects the type of product produced. The following are illustrative of the types of products which may be obtained using sulfur dichloride: (1) a product prepared by the reaction of 4 mols of a monoalkyl-substituted phenol with 3 mols of sulfur dichloride:

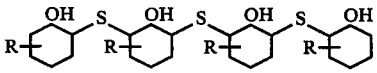

where R represents an alkyl radical.

(2) A product prepared from 2 mols of an alkyl phenol with 1 mol of sulfur dichloride:

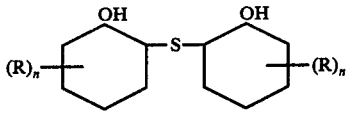

where R represents an alkyl radical and $n$ is an integer from 1 to 4.

(3) A product prepared from an alkyl phenol with sulfur dichloride in a 1:1 mol ratio:

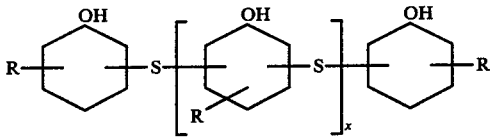

where R represents an alkyl radical and $x$ is an integer of 2 to about 6. These products are usually referred to as phenol sulfide polymers.

It will be understood that although the types of compounds above-illustrated represent the principal phenol sulfide products provided by the reacting proportions of alkyl phenol and sulfur dichloride specified, the products in all cases are actually mixtures of various phenol sulfides containing at least small amounts of di- and polysulfides, such as the following:

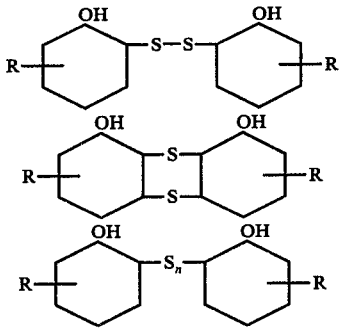

where R is alkyl and $n$ is an integer from 3 to 6.

As ordinarily manufactured on a commercial basis the phenol sulfides are prepared from mixtures of alkyl phenols and not from pure compounds. It will be understood then that the present invention has application to phenol sulfides in general, including specific relatively pure alkyl phenols as well as mixtures thereof.

A portion of the phenol hydroxyl groups in these alkyl phenol sulfides is esterified with phosphoric acid to produce a phosphonate, and the partially phosphonated material is then reacted with the oxides or hydroxides of an alkaline earth metal to produce the phenate compounds. The preferred alkaline earth metal alkyl phosphonate-phenate sulfides useful in this invention are slightly overbased calcium phosphonate-phenate sulfides. A particularly suitable calcium phosphonate-phenate sulfide is available from Edwin Cooper Inc. of St. Louis, Missouri as HITEC E-686. Typical characteristics of this product are:

| | Dark, yellow-brown viscous liquid | |
|---|---|---|
| Appearance | Min. | Typical |
| Calcium, % (wt) | 1.55 | 1.65 |
| Phosphorus, % (wt) | 0.9 | 1.03 |
| Sulfur, % (wt) | 2.4 | 3.2 |
| Specific Gravity at 60/60° F | | 0.94 |
| Viscosity at 210° F., cs. | | 45 |
| Total Base Number | | 50 |

In general, the preferred alkaline earth metal phosphonate-phenate sulfides useful in this invention are calcium phosphonate-phenate sulfides in which from 20–40 percent of the phenol hydroxy groups have been phosphonated.

The alkaline earth metal sulfonates should be present in the compositions in an amount of from 0.2 to 1.2 percent by weight of active ingredient. It will be appreciated that these sulfonates are generally available blended with a base oil for ease in handling, and typically are about 30 percent active ingredient. In the most preferred form of the invention, the alkaline earth metal sulfonate is magnesium sulfonate and is present in an amount of from 0.4 to 1 weight percent (active ingredient).

The alkaline earth metal alkyl phosphonate-phenate sulfide is preferably a calcium compound and is present in an amount of from 0.2 to 2.0 percent by weight (active ingredient), and most preferably is calcium alkyl phosphonate-phenate sulfide present in an amount of about 0.5 percent by weight.

The beneficial anti-rust properties of this invention are obtained by utilizing a ratio of magnesium sulfonate to calcium phosphonate-phenate sulfide of from 0.5:1 to 1.5:1 and preferably in a ratio of about 1:1 based on weight percent active ingredients.

The improved rust inhibition properties provided by this invention are illustrated in the following example, in which a standard Sequence II-C engine rust test was performed on the oil composition, followed by a duplicate test on the same oil sample to provide a severe test. The standard Sequence II-C procedure involves the operation of a 425 cubic inch 1967 Oldsmobile V-8 engine under low speed, low temperature conditions. Upon completion of the test (32 hours), the engine is inspected for evidence of rust and valve lifter sticking. The test is carried out under carefully controlled conditions of engine speed, load, oil and coolant temperatures, air fuel ratios, carburator air temperature and humidity levels, exhaust back pressure levels, etc. In order to provide a severe test of the composition of this invention, the composition was subjected to a double Sequence II-C test in which the standard Sequence II-C was performed twice on the same oil sample. Two compositions, essentially identical except that in one case magnesium sulfonate was utilized as the rust inhibitor and in the other case a combination of magnesium sulfonate and calcium phosphonate-phenate sulfide was utilized, were performed, and the average rust rating (scale 1–10) obtained was 8.7 for the composition of the invention, whereas the rust rating for the composition utilizing only magnesium sulfonate as a rust inhibitor was 5.8. The specific compositions of the two oils tested are shown below.

| Ingredient | Wt. % | Wt. % |
|---|---|---|
| Ashless Dispersant | 8.0 | 8.0 |
| Magnesium Sulfonate (30% active ingredient) | 2.4 | 2.4 |
| Calcium Phosphonate-Phenate Sulfide (45% active ingredient) | 2.0 | — |
| Zinc Dithiophosphate | 1.9 | 1.9 |
| Viscosity Index Improver | 7.5 | 7.5 |
| 100 SSU Base Oil | 65.1 | 65.1 |
| 170 SSU Base Oil | 13.0 | 15.0 |
| Rust Rating (Scale 1-10) Double Sequence II-C | 8.7 | 5.8 |

The difference in rust rating obtained in this experiment is very significant, and the rating of 8.7 obtained from the composition of the invention is particularly impressive in view of the severity of the experiment.

The composition which gave a rust rating of 8.7 in the above test is well suited as an extended surface crankcase lubricating oil composition. Such a composition, however, in certain conditions exhibits increased viscosity after a substantial service life, and an improved composition which is not subject to this deficiency is exemplified by the following composition.

| Ingredient | Wt. % |
|---|---|
| Ashless Dispersent | 5.0 |
| Magnesium Sulfonate (30% active ingredient) | 1.5 |
| Calcium Phosphonate-Phenate Sulfide (45% active ingredient) | 2.0 |
| Zinc Dithiophosphate | 1.9 |
| Viscosity Index Improver | 7.5 |
| Base Oil | Balance |

The foregoing description and the specific examples are intended to be exemplary rather than limiting of the invention, and it will be appreciated by those skilled in the art that numerous variations and modifications could be made without departing from the invention.

We claim:

1. In a crankcase lubricating oil composition consisting of a base oil and an additive package, the improvement wherein the composition contains from 0.2 to 1.2 percent by weight active ingredient of overbased magnesium sulfonate having a base number of about 400 and from 0.2 to 2.0 percent by weight active ingredient of slightly overbased calcium phosphonate-phenate sulfide, and the ratio of magnesium sulfonate to calcium phosphonate-phenate sulfide is from 0.5:1 to 1.5:1.

2. The composition of claim 1 wherein from 20 to 40 percent of the phenol hydroxy groups of said calcium phosphonate-phenate sulfide are phosphonated.

3. The composition of claim 1 wherein the composition contains 0.45 percent by weight magnesium sulfonate and 0.9 percent by weight calcium phosphonate-phenate sulfide.

4. The composition of claim 1 wherein the base oil is a solvent refined neutral base oil.

* * * * *